United States Patent [19]

Griffith et al.

[11] Patent Number: 4,770,717

[45] Date of Patent: Sep. 13, 1988

[54] COMPOSITIONS AND PROCESS FOR METAL TREATMENT

[75] Inventors: Edward J. Griffith, Manchester; Toan M. Ngo, Eureka, both of Mo.

[73] Assignee: Monsanto Company, St. Louis, Mo.

[21] Appl. No.: 102,701

[22] Filed: Sep. 30, 1987

[51] Int. Cl.[4] ..... C23C 22/78

[52] U.S. Cl. ..... 148/6.17; 148/6.15 Z; 148/6.15 R

[58] Field of Search ..... 148/6.15 R, 6.15 Z, 148/6.17

[56] References Cited

U.S. PATENT DOCUMENTS

| | | | |
|---|---|---|---|
| 2,310,239 | 2/1943 | Jernstedt | 148/6.15 R |
| 2,456,947 | 12/1948 | Jernstedt | 148/6.15 R |
| 2,462,196 | 2/1949 | Jernstedt | 148/6.15 R |
| 2,490,062 | 12/1949 | Jernstedt | 148/6.15 R |
| 3,741,747 | 1/1973 | Hamilton | 148/6.15 R |
| 3,864,139 | 2/1975 | Heller | 106/6.15 R |
| 4,152,176 | 5/1979 | Guhde | 148/6.15 R |
| 4,497,667 | 2/1985 | Vashi | 148/6.15 R |
| 4,539,051 | 3/1985 | Hacias | 148/6.15 R |

*Primary Examiner*—Sam Silverberg

*Attorney, Agent, or Firm*—R. Loyer; A. Hoffman; A. Cole

[57] ABSTRACT

Compositions and processes for activating metal surfaces prior to coating with a phosphate compound are disclosed. Colloidal alkyl benzene sulfonate salts are disclosed as a novel class of activating materials to replace titanium containing Jernstedt salt baths for treatment of metal surfaces prior to coating with a protective phosphate material.

11 Claims, No Drawings

COMPOSITIONS AND PROCESS FOR METAL TREATMENT

BACKGROUND OF THE INVENTION

This invention relates to compositions and processes for metal treatment prior to coating the metal surfaces with a protective layer of a phosphate compound. More particularly, novel colloidal alkyl benzene sulfonate salts compositions are provided which are useful for the treatment of ferrous type metals prior to applying protective coatings such as zinc or calcium phosphate compounds.

The art of forming protective layers on ferrous metals has been the subject of investigation for many years. It has long been known to apply coatings to metal, particularly to ferrous metals, for the purpose of inhibiting corrosion. Paint materials as protective coatings are common and it is known that by improving the adhesion of paint to the metal more durable protection is provided by the paint.

In efforts to provide improved adhesion of paint layers on ferrous metals it was discovered that a thin layer of zinc phosphate directly on the metal greatly increased the ability of paint to adhere as well as inhibit corrosion.

The phosphating art greatly improved when it was discovered that ferrous metal surfaces treated or contacted with a solution containing a small amount of titanium together with sodium phosphate prior to zinc phosphating provided a zinc phosphate layer on the metal which was more evenly distributed and in smaller particle size. This discovery was made by G. W. Jernstedt who was awarded several patents in the area including U.S. Pat. Nos. 2,310,239; 2,456,947; 2,462,196 and 2,490,062. It is believed that the solution of sodium phosphate and titanium "activate" the metal such that the metal is more readily coated with zinc phosphate in the following step. The titanium containing materials or activating compositions became known as "Jernstedt salts".

Typically, Jernstedt salts are prepared by first dissolving disodium phosphate in water and adding titanium as a soluble salt. The aqueous solution is heated within a limited temperature range of from about 60° C. to about 85° C. with mixing for about 10 hours. The solution is then evaporated to dryness at elevated temperatures and the dry material is used to prepare aqueous solutions for metal pretreatment. It is known that the temperature to which the initial titanium of sodium phosphate solution is heated prior to evaporation is critical. Such temperature can be varied within only narrow limits as higher temperatures result in degraded product and lower temperatures result in inactive product.

Because of the sensitivity of Jernstedt salts with respect to the temperature range employed in their preparation, attempts have been made to eliminate the need for any heat to form the dry solid activating compositions. One other reason for attempting to eliminate the heating step is to conserve energy. One attempt in reducing the requirement for heat in the preparation of Jernstedt salts is shown in U.S. Pat. No. 4,152,176 to Guhde. This patent describes a method for preparing a Jernstedt salt, which includes sodium tripolyphosphate as a cleaner for the metal, by the steps of preparing a mixture of water, sodium tripolyphosphate, disodium phosphate and a titanium-containing compound. This aqueous mixture is heated to a temperature of from 65° C. to about 95° C. and the solution is then added to solid disodium phosphate with mixing to obtain a solid titanium phosphate composition. The solid composition is then employed to prepare solutions for treating metal surfaces prior to aqueous phosphating in the typical manner. Although the final mixture with disodium phosphate is considered to provide a dry activating composition such compositions contain about 15% water. Such mixtures are then employed to prepare Jernstedt salt solutions in the usual manner.

Further attempts to improve upon Jernstedt salts is shown in U.S. Pat. No. 4,539,051 to Hacias. In the aforementioned patent the Jernstedt salt contains tetrasodium pyrophosphate in addition to the small amount of titanium and a sodium phosphate compound. It is claimed that by including the pyrophosphate, comparatively smaller amounts of the dry particuate salt are required in aqueous metal treating solution to activate the metal and thus provide superior phosphate coating.

The aqueous treatment bath temperature at which a metal surface is to be effectively treated has been known to be in the range of from about 49° C. to about 64° C. for one step cleaning and conditioning or activating. In an effort to reduce the required temperature of the bath, multi-component baths have been disclosed wherein the basic Jernstedt salt solution is employed together with other ingredients which perform adequate metal conditioning prior to the phosphating process. One such disclosure is found in U.S. Pat. No. 4,497,667 to Vashi. According to this patent the aqueous bath temperature is lowered to about 38° C. while obtaining adequate conditioning. Surfactants, sequestrants, buffers such as alkali metal carbonates, silicates and other ingredients are employed to achieve the desired result.

In all of the known preparations of Jernstedt salts it is the conventional wisdom to incorporate in aqueous solution a titanium salt having some solubility in water together and a sodium phosphate compound followed by heating these ingredients together at a temperature within a narrow range. In most instances the aqueous solution is evaporated to dryness requiring close attention to avoid an inferior product.

While numerous attempts have been made to improve the performance of the titanium containing Jernstedt salt baths with respect to the activation of metal surfaces a common problem with all such salts has been the meticulous care with which the titanium containing material is prepared. Further, there is a need for more convenient preparation of an activating material and obvious benefits would inure should a less expensive material than titanium be found which will activate ferrous type metal as that obtained employing the traditional titanium containing Jernstedt salts.

SUMMARY OF THE INVENTION

The present invention provides novel compositions and methods for activating metal surfaces comprising aqueous solutions of an activating amount of a colloidal alkyl benzene sulfonate salts. Such salts have been found to be useful either alone or in combination with titanium salts previously known to be useful in Jernstedt salts or in combination with alkali metal phosphate salt, preferably disodium phosphate. In a more preferred embodiment of this invention, aqueous solutions capable of activating metals selected from the group consisting of iron, steel, zinc, and alloys of said metals comprise an activating amount of a colloidal alkyl benzene sulfonate salt selected from alkali metal and alkaline earth metal salts. It has been found to be advantageous to employ the calcium salt of a linear alkyl benzene sulfonate.

The process of this invention whereby metal surfaces are activated as a pretreatment in the process for coating the metal with a protective layer of phosphate salt is performed by simple exposing the metal surface to an activating solution containing the colloidal alkyl benzene sulfonate salt much in known manner with respect to metal surface activation.

DETAILED DESCRIPTION OF THE INVENTION

The novel compositions of this invention are most easily prepared by simply mixing together in aqueous solution an alkyl benzene sulfonate and a alkali metal or alkaline earth salt, preferably a halide salt, to form a colloidal salt of the alkyl benzene sulfonate. Dilute aqueous solutions are preferred to form the colloid of this invention now found to be an activator for metal surfaces in place of a titanium containing Jernstedt salt. Other salts of alkyl benzene sulfonates are typically sodium, potassium, magnesium, etc.

The alkyl benzene sulfonate salts of this invention are derived from those most conveniently obtained from surfactant manufacturers. One preferred alkyl benzene sulfonate salt is a mixture having alkyl groups of $C_{11}$–$C_{18}$ with the major components having $C_{11}$ and $C_{12}$ alkyl groups. Although not critical, the alkyl group is desirably in the paraposition with respect to the sulfogroup. The typical linear alkyl benzenes are mixtures of secondary-substituted n-alkanes. Polypropylene based alkyl benzene sulfonates are also available but are not preferred because of their limited or lack of biodegradable tendency.

In the event it is desired to simply reduce the amount of titanium employed or to improve its performance it is possible to mix together a traditional titanium ion containing Jernstedt salt with a colloidal alkyl benzene sulfonate salt prepared as described above. Such mixtures may be of any proportion of titanium ion and colloidal alkyl benzene sulfonate salt. In general, the colloidal alkyl benzene sulfonate salt is present in the aqueous pretreatment solution in an amount which is in the range of from about ½ to about 3 times the amount of titanium compound expressed as grams per liter of solution. The aqueous solutions are easily prepared by simply dissolving the components in separate solutions and combining the solutions in measured quantities.

While the colloidal alkyl benzene sulfonate salt may be employed as the activating material alone it has been found to be most advantageous to employ the colloidal alkyl benzene sulfonate salt together with an alkali metal phosphate salt. In such instance any amount of alkali metal phosphate salt may be employed to obtain more advantageous phosphate coating in the final coating step. Typically, a weight ratio of the alkali metal phosphate salt to the colloidal alkyl benzene sulfonate salt is in the range of from about 2:1 to about 4.1 and typically in the range of from about 3:1.

In those instances wherein the colloidal alkyl benzene sulfonate salt is employed as the only essential ingredient of the activating solution, any activating amount of the salt may be employed. However, the colloidal alkyl benzene sulfonate salt is typically employed in the range of from about 0.05 grams per liter of solution to about 2 grams per liter of solution. A solution in the range of concentrations given will have a pH in the range of from about 8 to about 9. The process of this invention is performed by dipping cleansed metal into an aqueous bath containing the colloidal alkyl benzene sulfonate salt of this invention for a sufficient period of time to activate the metal surface. Typically, the metal is immersed in the pretreatment bath of this invention for about 20 to about 60 seconds. The pretreatment bath is held at any convenient temperature ranging from room temperature up to about 50° C. although the pretreatment bath temperature is not critical.

The alkyl benzene sulfonate useful in the compositions and processes of this invention are typically the linear alkyl benzene sulfonates well known as surfactants in detergent formulations. The alkyl portion of the alkyl benzene sulfonate contains from about 8 to about 16 carbon atoms and is preferably linear although branched chain alkyl benzene sulfonate salts are also useful in the compositions and processes of this invention. The cation portion of the alkyl benzene sulfonate salt is selected from either alkyl metal or alkaline earth metals and is preferably either sodium or calcium. The calcium cation is particularly preferred in the compositions and processes of this invention when the phosphating step subsequent to the activation step is performed with a calcium phosphate salt rather than zinc phosphate. In a preferred embodiment the major component of the linear alkyl benzene sulfonate salt is calcium dodecylbenzene sulfonate.

In the preparation of colloidal alkyl benzene sulfonate salt for compositions and processes of this invention, it has been found preferable to employ alkyl benzene sulfonates prepared by means of air-$SO_3$ sulfonation processes carefully performed to minimize char formation and possible sulfonation of the hydrocarbon chain of the alkyl benzene. Alkyl benzene sulfonates prepared by means of the traditional oleum route contain more by-product and it is well known that such reactions do not reach completion making the product more difficult to be purified. It is apparent from this disclosure that the use of relatively more pure sources of alkyl benzene sulfonate to prepare the salt and the colloidal compositions employed in the metal activating processes of this invention is preferred.

The following examples serve to illustrate the invention but are not intended to limit it thereto.

EXAMPLE 1

A colloidal solution of calcium dodecyl benzene sulfonate was prepared by combining in water the alkyl benzene sulfonate at a concentration of 0.75 grams per liter and calcium chloride at a concentration of 0.0912 grams per liter. After thorough mixing the calcium salt of the alkyl benzene sulfonate was formed having a pH of 8 and ready for use in the pretreatment process to activate a metal surface prior to phosphate coating.

EXAMPLE 2

A colloidal calcium linear dodecyl benzene sulfonate salt concentrate is prepared by combining in aqueous solution 33.33 grams of calcium dodecyl benzene sulfonate and 4.05 grams of calcium chloride per 100 grams of disodium phosphate anhydrous. A portion of the solution was then diluted with deionized water to provide a solution equivalent to 5 grams of the alkyl benzene sulfonate salt per liter and 0.0608 grams of calcium chloride per liter of solution.

The diluted solution is ready for use as a pretreatment solution for metal surfaces prior to being immersed in a phosphate coating bath.

EXAMPLE 3

A metal surface activating pretreatment bath was prepared by mixing together in aqueous solution the ingredients shown in the table below wherein DSPA means disodium phosphate anhydrous.

| Expt. #1 | grams/100 grams DSPA total | grams/liter solution |
|---|---|---|
| Ti | 0.6384 | 6.38 ppm |
| $TiO.SO_4.H_2SO_4.8H_2O$ | 5.36 | 0.0561 |
| $TiO.SO_4$ | 2.13 | 21.30 ppm |
| $Na_2CO_3$ | 0.36 | 0.0034 |
| NaCl | 0.19 | 0.0018 |
| Chloride ion | 0.1152 | 1.15 ppm |
| sodium dodecylbenzene sulfonate[1] | 2.50–6.94 | 0.0250–0.1250 |

[1]Major portion of a mixture

An activating solution containing the above-indicated amounts of sodium dodecyl benzene sulfonate are useful as pretreatment solutions to activate metal surfaces prior to the phosphate coating step employing a salt of ortho-phosphoric acid.

EXAMPLE 4

Stock solution No. 1 is prepared by combining 105.29 grams of calcium hydroxide with 193.53 grams of phosphoric acid (85.45%) and 158.05 grams of nitric acid (conc.). Stock solution No. 2 was prepared by combining 139.7 grams of sodium nitrite with 1 liter of deionized water.

A coating bath was prepared by combining 150 ml of stock solution No. 1 with 8 ml of stock solution No. 2 in three liters of deionized water. The solution was found to have a pH, at 28° C., of about 2.2.

EXAMPLE 5

A Jernstedt salt containing active titanium ions is prepared according to the following procedure. Into 20 ml of warm deionized water were dissolved 15 grams of titanium sulfate ($TiOSO_4 \cdot H_2SO_4 \cdot 8H_2O$) with the water temperature held in the range of about 45° C. to about 55° C. To the deionized water were previously added 0.99 grams of sodium carbonate and 0.54 grams of sodium chloride. Then a clear solution was obtained (in about 35 minutes) the solution was added slowly to 87.75 grams of dry disodium phosphate dihydrate. During the addition of the liquid to the solid disodium phosphate dihydrate the mixture was agitated manually by means of a mortar and pestal. The mixture was then heated slowly at a temperature in the range of from 45° C. for about 55° C. for 15 minutes while mixing continued. There was produced a gel-like paste which was then dried an an oven at a temperature in the range of between 70° C. and 80° C. for about 2 hours to form a dry particulate mixture. A pretreatment bath was prepared by combining 0.4 grams of the above-described dried mixture and 1.4 grams of anhydrous sodium phosphate in 1.8 liters of deionized water. Such pretreatment bath was found to have a pH of about 8.2.

EXAMPLE 6

A metal coupon comprising 1010 mild steel was first cleansed by immersion in a 2% solution of sodium hydroxide held at 60° C. for 2.5 minutes. After withdrawal from the caustic solution, the coupon was rinsed thoroughly with deionized water and submerged into the pretreatment bath of example 5 for 30 seconds at room temperature. Immediately after withdrawal from the solution of Example 5, metal coupon was immersed in the coating solution of Example 4 for a period of 2.5 minutes while the coating bath was held at 67.2° C. Upon withdrawal from the coating bath, the coupon was rinsed with deionized water and dried to reveal a dense, transparent hydrophobic and oleophilic layer of phosphate compound believed to be calcium phosphate.

EXAMPLE 7

A metal coupon was given the same treatment as in Example 6 with the exception that the pretreatment bath of Example 5 was replaced with the pretreatment bath of Example 1. After removal from the coating bath and drying the metal coupon was found to have a dense coating of a phosphate compound on its surface.

EXAMPLE 8

The procedure of Example 6 was repeated with the exception that the pretreatment bath was replaced with the pretreatment bath of Example 2. After removal of the coupon from the coating solution, it was found to be coated with a dense fine grained coating of a phosphate compound similar to that obtained in Example 6.

EXAMPLE 9

The procedure of Example 6 was repeated with the exception that the pretreatment bath was replaced with the pretreatment bath of Example 3. Upon withdrawal of the metal coupon from the coating bath, it was found to have a dense fine grained phosphate coating.

The pretreatment solutions of this invention have been found to be useful with processes for coating ferrous metals with zinc phosphate as well as with the calcium compound as described above. The coating treatment is performed with previously known zinc phosphate coating baths employed with typical titanium ion containing Jernstedt salt pretreatment baths. Calcium phosphate containing coating baths are preferred because the size of the grains in the coating appear smaller or finer than when zinc phosphate is employed in the coating bath. Zinc phosphate baths are prepared in known manner and may be substituted for the calcium phosphate bath of Example 4. When employed after pretreatment in accordance wilh this invention a protective coating of zinc phosphate on the metal surfaces is provided.

Although this invention has been described with reference to the pretreatment baths of the above examples, it is apparent that the pretreatment solutions may also contain other additives such as adjuvants, cleaning agents, etc.

While it is apparent that the preferred embodiments of the invention disclosed are well calculated to fulfill the objectives of the present invention, it will be appreciated that the invention is capable of modification, variation and change without departing from the scope or fair meaning of the following claims.

We claim:

1. The process for treating metals selected from the group consisting of iron, steel, zinc and alloys of said metals prior to producing thereon corrosion resisting phosphate coatings, the step comprising applying to the metal surfce an aqueous solution containing an activating amount of a colloidal alkyl benzene sulfonate salt, selected from alkali metal and alkaline earth metal salts.

2. A process of claim 1 wherein the alkyl benzene sulfonate salt is an alkaline earth metal salt.

3. A process of claim 2 wherein the alkaline earth metal salt is calcium.

4. A process of claim 1 wherein the alkyl benzene sulfonate salt is an alkali metal salt.

5. A process of claim 4 wherein the alkali metal is sodium.

6. A process for treating metals selected from the group consisting of iron, steel, zinc, and alloys of said metals comprising applying to the metal surface an adequate solution containing an activating amount of a collodial alkyl benzene sulfonate salt selected from alkali metal and alkaline earth metal salts and an akali metal phosphate salt.

7. A process of claim 6 wherein the alkali metal salt is disodium phosphate.

8. A process of claim 7 wherein the weight ratio of disodium phosphate to alkyl benzene sulfonate salt is in the range of from about 2:1 to about 4:1.

9. A process of claim 2 wherein the alkyl benzene sulfonate salt is a mixture wherein the alkyl group contains from 11 to 18 carbon atoms.

10. A process of claim 9 wherein the alkyl group is linear.

11. A process of claim 10 wherein the alkyl group is a secondary-substituted n-alkane.

* * * * *

UNITED STATES PATENT AND TRADEMARK OFFICE

CERTIFICATE OF CORRECTION

PATENT NO. : 4,770,717

DATED : September 13, 1988

INVENTOR(S) : E. J. Griffith et al

It is certified that error appears in the above—identified patent and that said Letters Patent is hereby corrected as shown below:

In column 3, line 9, delete "simple" and insert --simply--.

In column 3, line 61, delete "4.1" and insert --4:1--.

In column 4, line 66, delete "5" and insert --.5--.

Signed and Sealed this

Twenty-fourth Day of January, 1989

*Attest:*

DONALD J. QUIGG

*Attesting Officer*

*Commissioner of Patents and Trademarks*